US005492425A

United States Patent [19]

Carter et al.

[11] Patent Number: 5,492,425

[45] Date of Patent: Feb. 20, 1996

[54] APPLICATOR FOR GRIP-ENHANCING SUBSTANCES

[75] Inventors: Joe Carter; Bill Hildenbrand, both of Edmond, Okla.; Thomas W. McQuaide, Union Town, Ohio

[73] Assignee: Joe Carter Enterprises, Edmond, Okla.

[21] Appl. No.: 272,226

[22] Filed: Jul. 8, 1994

[51] Int. Cl.[6] ..... B05C 17/00

[52] U.S. Cl. ..... 401/10; 401/11

[58] Field of Search ..... 401/9, 10, 11

[56] References Cited

U.S. PATENT DOCUMENTS

| | | | |
|---|---|---|---|
| 1,936,757 | 11/1933 | Garvey | 401/10 |
| 2,255,154 | 9/1941 | Esposito | 401/9 X |
| 2,490,650 | 12/1949 | Reckler . | |
| 2,604,650 | 7/1952 | Mottelson | 401/11 X |
| 3,229,321 | 1/1966 | Watts . | |
| 3,712,748 | 1/1973 | Wilmans . | |
| 3,869,307 | 3/1975 | Newman et al. | 117/122 PA |
| 3,922,438 | 11/1975 | Brown et al. | 428/411 |
| 3,924,728 | 12/1975 | Brown et al. | 197/172 |
| 3,978,274 | 8/1976 | Blum | 428/476 |
| 4,084,286 | 4/1978 | Post . | |
| 4,135,274 | 1/1979 | Freeman . | |
| 4,139,195 | 2/1979 | Dreesen et al. . | |
| 4,517,702 | 5/1985 | Jackson | 401/10 X |
| 4,783,354 | 11/1988 | Fagan | 428/40 |
| 4,909,650 | 3/1990 | Gilbert . | |
| 4,953,999 | 9/1990 | Rivers | 401/11 X |
| 5,022,493 | 6/1991 | Buckelew | 401/9 X |
| 5,060,943 | 10/1991 | Stoffo . | |
| 5,094,557 | 3/1992 | Nelson et al. | 401/11 |

*Primary Examiner*—Steven A. Bratlie

*Attorney, Agent, or Firm*—Oldham & Oldham, Co., Inc.

[57] ABSTRACT

The invention described herein pertains generally to an applicator for use in translating a grip-enhancing substance onto a piece of equipment. The applicator is essentially tubular in nature and has a longitudinal slit along the length of the applicator thereby permitting a piece of equipment to be inserted thereto. The applicator has an absorbent inner component which is adhesively secured to the foamed exterior component, the inner layer having the grip-enhancing substance applied thereto. Through the application of a force, typically a squeezing action, onto the exterior of the applicator, a controllable amount of the grip-enhancing substance is transtarred from the inner component to the inserted piece of equipment. In one embodiment, the grip-enhancing substance is a replacement for pine tar, and is a synthetic polymer blend, the degree of tack of the product being both a function of the composition of the polymer(s) used in the composition, and when the composition is a mixture of two or more polymers, by the ratio of the two components.

20 Claims, 1 Drawing Sheet

APPLICATOR FOR GRIP-ENHANCING SUBSTANCES

TECHNICAL FIELD

The invention described herein pertains generally to an applicator for use in transferring a tacky or grip-enhancing substance onto a piece of equipment, typically sporting equipment.

BACKGROUND OF THE INVENTION

The baseball bat is the offensive weapon by which the batter may impose his will upon the pitcher's delivery. According to Official Baseball Rule 3.02 "No player shall intentionally discolor or damage the ball by rubbing it with soil, rosin, paraffin, licorice, sand-paper, emery paper or other foreign substance." In baseball's inimitable quality of maintaining balance, similar restrictions are placed upon the batter and his weapon.

Early baseball rules required only that the bat be round, wood, no more than 2.5 inches in diameter at the thickest part and "of any length to suit the striker." In 1872 and 1873, the rules provided that the "batter shall be privileged to use his own private bat exclusively. No player of the opposing club shall have any claim to the use of the bat except by consent of the owner." In 1874, the rules required that the bat be entirely of wood, so that any metal or "other material" on it would render it illegal. In 1885, the handle of the bat could be wound with twine not to exceed 18 inches from the end. In 1886, this rule was modified to allow the bat to have "a granulated substance" (presumably rosin) on the bat handle for the same 18 inches. The maximum diameter of the bat was increased to 2.75 inches in 1895 and the maximum length was fixed at 42 inches in 1893.

Although the bat rule was reworded in a major 1949 recodification, these basics still applied. In 1954, the rule allowed the bat handle to be roughened or wrapped with tape or twine for the "18 inches from which the bat is gripped." A 1975 modification permitted the other end of the bat to be "cupped," but the indentation must be "curved with no foreign substance added." In 1976, pine tar made its first official entry into the Rules, when Rule 1.10(b) was changed to allow the bat handle to be "covered or treated with any material (including pine tar) to improve the grip." A violation of the 18 inch limitation "shall cause the bat to be removed from the game." The material shall not "improve the reaction or distance factor of the bat."

Rule 1.10(b) was an apparent exception to Rule 6.06(d), which allowed the umpire to declare a batter out and to eject him from the game if he uses or attempts to use a bat that "has been altered or tampered with in such a way to improve the distance factor or cause an unusual reaction on the baseball," such as by being covered "with a substance such as paraffin, wax, etc."

On Jul. 24, 1983, Kansas City Royals third baseman George Brett hit a two-run home run to give his team an apparent 5-4 win against the New York Yankees, but the umpire, upon the urging of Yankee manager Billy Martin, measured the pine tar and determined that the pine tar was excessive. He ejected Brett under Rule 6.06(d), but the protest by the Royals was upheld by the league president. The fault, according to the league, lay in the rules, not in the umpire. That winter the Official Rules Committee reworded and renumbered Rule 1.10(b). It now reads: "The bat handle, for not more than 18 inches form its end, may be covered or treated with any material or substance to improve the grip. Any such material or substance, which extends past the 18 inch limitation, shall cause the bat to be removed from the game. If the umpire discovers that the bat does not conform to the above until after a time during or after which the bat has been used in play, it shall not be grounds for declaring the batter out, or ejected from the game." The Rule has not been changed since.

So pine tar entered baseball and baseball approved of it. That does not mean pine tar is attractive or desirable. As any baseball fan can tell you, George Brett was such a user of the substance that the visor of his Royals-blue batting helmet took on a distinctive brown color by the mid-summer All Star game every year. And the preferred method of application leaves much to be desired. Pine tar is usually applied to a cloth, the "pine tar rag," from which it is transferred to the bat by rubbing the rag on the bat handle. This application generally occurs in the "on deck circle," a dirt area between the player bench and the batters box. Between uses, the rag is thrown in the dirt and subjected to the weather, including the rain. Before long, the majority of what actually gets applied to the bat is something other than pine tar, which results in more vigorous application, and an overall messy situation. Dirty and wet, the pine tar rag is not a pleasant sight to retrieve at the end of the game.

A need for a good grip is not unique to baseball. Golfers, racquet sports players and hockey players, among others, need the grip, but they have not adopted the colorful and aromatic pine tar and the wonderfully transportable pine tar rag.

While pine tar is as ubiquitous as rosin bags, particularly at the major league level, the product is used simply because an effective alternative did not exist. When used regularly, the product tends to accumulate on the bat handle, and is extremely difficult to remove, particularly in accommodations where major league ballplayers would reside. While gasoline and turpentine are somewhat effective solvents, fire regulations and safety concerns prohibit the use of such products within confined hotel spaces. Therefore, players have had to resort to hair dryers, and knives in an attempt to remove unwanted accumulations of pine tar. The product is simply too sticky.

While a good grip is essential, there is a point beyond which it is a drawback. When a batter hits the ball onto the playing surface, there is an immediate need to have the bat released from the hitters' hands, thereby enabling him to assume the most aerodynamic position possible in his race to first base. The difference between a batter being safe or out at first base can be as small as a few fractions of a second.

Pine tar also possess a drawback of having adverse reactions by many products onto which it is transferred. Batting gloves for example, have a tendency to become stiff and uncomfortable after several exposures to pine tar applied to a bat handle. It is for these reasons that Joe Carter embarked upon an inventive path to both improve upon the applicator used to impart a grip-enhancing substance onto a surface, and to cooperatively research synthetic substitutes to this natural product with the University of Akron.

SUMMARY OF THE INVENTION

In accordance with the present invention, there is provided an applicator which is effective in transferring a tacky substance from the inside of the applicator onto an exterior surface of a piece of equipment where it is important to be able to grip the equipment securely.

It is an object of this invention to provide an applicator which is essentially tubular and having a longitudinal slit disposed therein to provide facile ingress and egress of a piece of equipment to which the tacky substance is to be applied to an exterior surface thereof.

It is another object of this invention to provide an essentially foamed pliable soft exterior component for the applicator thereby facilitating the migration of the tacky substance from the interior of the applicator to the exterior of the piece of equipment to which the tacky substance is to be applied by a simply squeezing of the applicator, optionally with a simultaneous twisting action.

It is still another object of this invention to provide an applicator which due to its essentially cylindrical shape, will not expose the tacky substance disposed on the inside of the applicator to dirt and dust when a user throws the applicator onto the ground.

It is yet another object of this invention to provide a tacky substance substitute for pine tar.

These and other objects of this invention will be evident when viewed in light of the drawings, detailed description, and appended claims.

DETAILED DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE INVENTION

Figure 1:
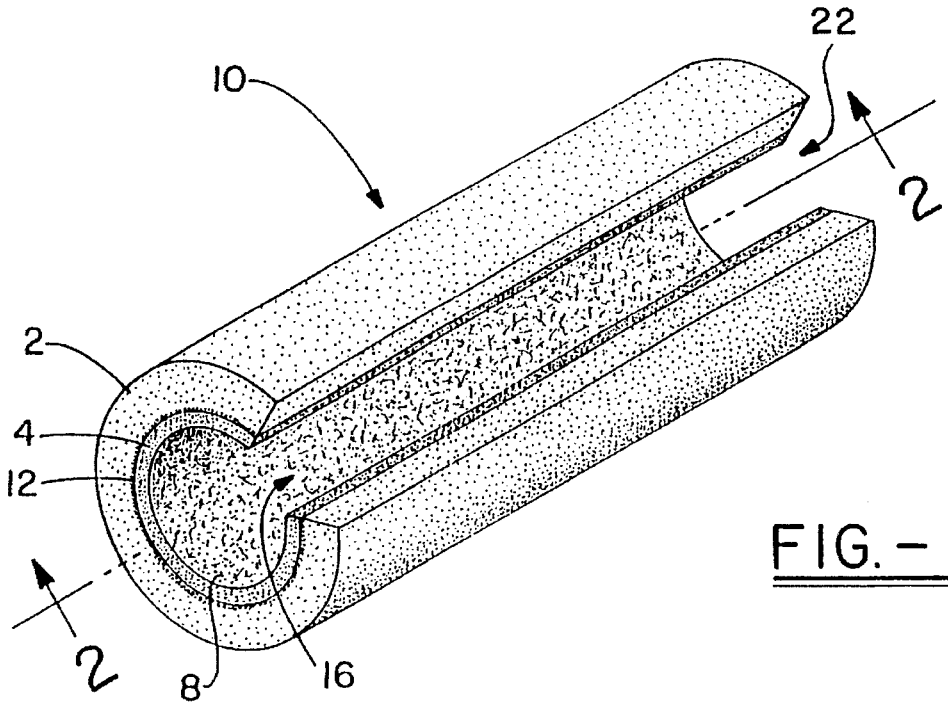
FIG. 1 is a perspective view of the applicator.
Figure 2:
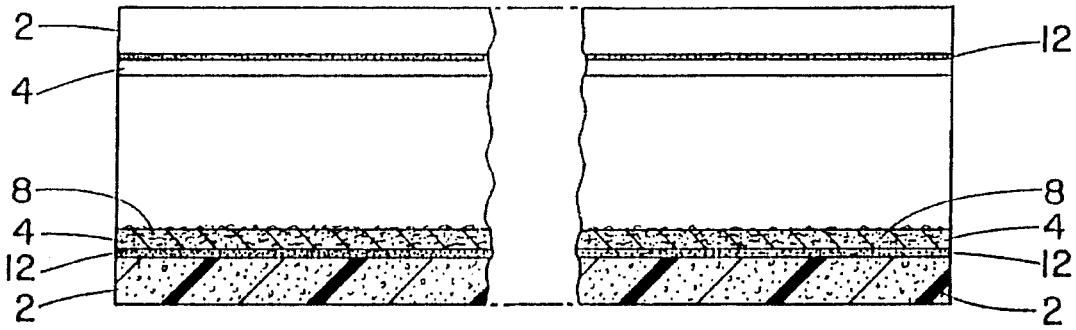
FIG. 2 is an enlarged cross-sectional view taken along line 2—2 of FIG. 1.

Referring now to the drawings wherein the showings are for purposes of illustrating the preferred embodiment of the invention only and not for purposes of limiting the same, the Figures show an applicator for use in transferring a tacky substance which resides on the interior of the essentially tubular applicator onto a piece of equipment, whether that equipment is related to sporting activities, e.g., baseball bats, hockey sticks, tennis racquets, racquetball racquets, golf clubs, polevaulting poles, etc., or the equipment is non-sport-related, e.g., handles on tools such as axes, hatchets, hammers, etc.

As best seen in FIG. 1, applicator 10 is shown having a longitudinal slit 16 disposed therein. The applicator has a pliable outer member 2 and a pliable inner member 4, the outer and inner members being secured to each other by adhesive 12. A tacky substance 8 resides either on the exterior surface of inner member 4 or depending upon the material of construction of the inner member, can be partially or totally absorbed thereinto.

In a preferred embodiment, the applicator is essentially tubular. The benefit of this tubular an angement is that subsequent to the use of the product, it can simply be tossed onto the ground, without the unwanted consequence of accumulating an undesirable amount of dust onto the tacky component of the applicator, which quickly decreases the effective lifetime of the product. No matter how the product is thrown, or upon what surface the product is tossed, the essentially tubular nature of the product will prevent the accumulation of tack-reducing materials, e.g., dirt, from diminishing the effectiveness of the product.

For some applications however, the essentially tubular applicator 10 may not have a longitudinal slit 16 disposed therein. In those applications, the applicator's internal diameter is such that it is sufficiently large to be capable of insertion over the handle of the apparatus to which the tacky substance 8 is to be transferred onto. Depending upon the material of construction of the outer and inner members of the applicator, it is possible to have somewhat larger diametered apparatii to be inserted into the tubular applicator, particularly when the members are sufficiently pliable as to be capable of expansion in a radial direction without tearing.

For ease of application, the preferred material of construction of outer member 2 is a flexible foam. Examples of flexible foams are polyurethane, rubber latex, PVC-nitriles, polyethylene or other vinyl polymers, e.g., polystyrene. The list of potential candidates for the outer member is quite varied, in that both vulcanized and thermoplastic compounds have been successfully foamed. A non-limiting list of such materials would include: (1) natural rubber; (2) synthetic rubbers, (e.g., polyisoprene, butyl rubber [poly-(isobutene/isoprene)], halogenated butyl rubber, chloroprene (e.g., neoprene®), ethylene propylene (EPM) and ethylene propylene diene rubber (EPDM), nitfile rubber (NBR), silicone rubber, chlorosulfonated polyethylene, chlorinated polyethylene, etc.); (3) urethane polymers, including thermoset and thermoplastics; (4) thermoplastics (e.g., polyethylene, poly(ethylene/vinyl acetate) copolymers, polypropylene, poly(vinyl chloride) (PVC), polyesters, etc.); (5) thermoplastic elastomers including styrenics (e.g., styrene/butadiene, styrene/ethylene/butene, styrene/olefin, and block copolymers thereof), olefinics (e.g., ethylene/propylene and butene derivatives (Santoprene®)) and urethanes including ether and ester types; (6) blends of the above: and (7) latex foams, including natural and synthetic rubber latices. The list is not inclusive and is merely illustrative of a large specific number of materials which could be contained therein. Other materials of the general nature described above are envisioned within the scope of the invention.

Characteristics which are desirable for the outer member are pliability and resistance to tearing upon the application of a twisting motion. In operation, a handle or cylindrical component of an apparatus is inserted into slit 16 or into opening 22 when the slit is not present. Since the applicator is pliable, there is no need to limit the dimensions of the product which is inserted into the slit. Diameters of inserted materials which are both larger and smaller than the nominal internal diameter of the applicator can be accommodated since the applicator will simply expand when the diameter of the inserted material is larger than that of the applicator. The tacky substance 8 is transferred from the exterior of inner member 4 to the exterior surface of the inserted material through a squeezing action, optionally coupled with a twisting action by the user about the periphery of the applicator. The outer member 2, typically foam, must possess sufficient integrity during this squeezing and twisting motion so that it does not tear prematurely during normal use.

Another characteristic which is highly desirable is that the material retain its shape during temperature swings. The product is envisioned to be used during the hottest days of summer, and during the coldest days of winter.

Preferred materials for the inner member 4 are those which can both absorb tacky materials and retain their integrity while being subjected to shear stresses which occur as the applicator is being used in applying the tacky substance to for example, the handle of a bat (e.g., cotton and felt).

Cotton is a major textile fiber and an important source of cellulose, which constitutes 88–96% of the fiber. In order to improve the heat, rot, and mildew resistance of cotton, the material can: acetylated, i.e., treated with acetic anhydride, acetic acid, and perchloric acid; aminized by reacting for example 2-aminoethylsulfuric acid with the cellulose of the fabric in a strongly alkaline solution; cyanoethylated, i.e., treated with acrylonitrile after passage through a caustic bath, with subsequent neutralization with acetic acid, washing and drying; or mercerized by passing through a 25–30% solution of base with the fibers under tension. In alternative embodiments, the cotton may be but one of several components incorporated into a blend material, e.g., cotton-polyester blends, such as Dacron®, a polyester fiber made from polyethylene terephthalate. Felt would be another example of an absorbent material, being a firm woven cloth of wool or cotton heavily napped and shrunk as would canvas. Of course, the composition of the inner member can include totally synthetic materials (e.g., plastic screen meshed materials, rubber or plastic sheets which are optionally embossed or textured with nipples, ribs, etc., synthetic woven products such as Scotch® Brite pads.

Another type of inner material would be a foamed polymer, of similar characteristics described previously. During the extrusion process, foamed polymers typically have a relatively non-penetrable surface layer imparted thereto, which would initially make them relatively unsuitable for use as an absorbent layer. However, if at least one of the relatively non-penetrable surface layers is removed, either through an etching process, or via mechanical removal, this type of material would then possess the desirable characteristics necessary for the inner component (e.g., a one-sided skinless foam).

In one embodiment of the invention, a single polymeric foamed material is fabricated with associated relatively non-penetrable surface layers on both sides of the foam. Through subsequent treatment of one side of the foam, the foam can now function as both an inner component and an outer component. In an optional embodiment, this unitary foamed product is provided with an essentially tubular shape through a post-processing heat treatment, or through other shaping methodologies known in the art.

Figure 3:
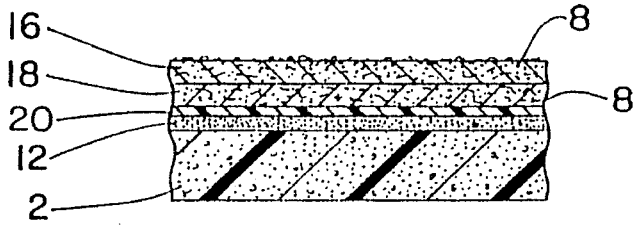
FIG. 3 is an enlarged cross-sectional view of the inner component of the applicator shown in FIG. 2 when the inner component is a multi-layered laminate.

In one alternative embodiment, the inner member is a laminate material as shown in FIG. 3. When employing this mode of construction, the inner component can be customized to maximize various functions. One layer of the laminate could be a first absorbent layer 16 in which a first tacky substance is absorbed, while a second absorbent layer 18 might be another absorbent layer, which may be the same or different from the first absorbent layer, in which a second tacky substance is absorbed, and yet a third layer 20 could be a barrier layer which prevents the absorbed tacky substances from penetrating through to adhesive layer 12, e.g., polyolefin film layer. While a three layer laminate is described above, there is no need to limit the application as such, and the invention encompasses all inner components which have at least one layer, progressing up to multiple layers. Manufacturing costs will be more of a product determinant, rather than any theoretical limitation.

The benefit of this laminated product is that depending upon the amount of pressure exerted by the user on the outer foamed member, both varying amounts of tacky substances, and different types of tacky substances could be transferred onto an inserted material, thereby permitting the user to customize the degree of tack imparted.

When the outer and inner members are not of unitary construction, they are typically fastened to each other by a permanent adhesive. Characteristics desirable for this adhesive would include the ability to withstand shear stresses during the twisting application of the product by the user without delamination of the outer and inner members. Another feature is the need for the adhesive to not fail when subjected to temperature extremes, such as would occur during natural climatological variations in the temperate zones of the world. In a preferred embodiment, the adhesive will not fail when exposed to water, as might occur should the product be left in the rain.

A non-limiting, exemplary list of such adhesives would include: (1) solvent-release (e.g., acrylics, acetates, rubber-based, crosslink acrylics, etc.); (2) hot melts; (3) ethylene/vinyl acetate based; (4) olefin based; (5) polyesters; (6) and thermosetting adhesives (e.g., urethane-based and epoxy-based, etc.). The list is not inclusive and is merely illustrative of a large specific number of materials which could be contained therein. Other materials of the general nature described above are envisioned within the scope of the invention.

The ultimate goal of the product however, is to impart a tacky substance 8 onto an inserted material. In its simplest form of operation, this tacky substance can be pine tar, which has been applied to inner component 4. However, pine tar is by its very nature, a sticky, viscous, dark brown to black liquid or semisolid with strong odor and sharp taste. Pine tar has been used historically in baseball to improve the batters grip and purported aid in the ability of the batter to make contact with a ball, which may at times be hurled toward the plate in a relatively straight line, but is today increasingly being tossed with varying degrees of spins thereby making the pitch an ever increasingly difficult target to hit effectively.

However, the modem day player is typically not satisfied with the use of pine tar, and many have moved toward batting gloves as an alternative, or at least to ameliorate the negative aspects of pine tar. One of the aspects of this invention is the development of a substitute to pine tar, which is safe and yet economical to use. One such product which has been developed is the combination of a thermoplastic saturated polymer, e.g., polyisobutylene (Vistanex®), and beeswax, which consists largely of myricyl palmitate, cerotic acid and esters, and some high carbon paraffins. The degree of tackiness of the combination can be controlled by varying the relative weight ratios of the components used. A higher percentage of Vistanex® in the composition will impart a higher tack value than one with a higher percentage of beeswax.

In general, the grip enhancing formulation would include any relatively low molecular weight polymer and wax combination. The requirements for the tacky substance would be that it impart good tack to the handle of the article which is to be gripped by the participant (e.g., baseball bat), have good transfer from the inner member of the applicator to the handle of the article, and additionally have good adhesion to the bat grip, which typically would be rubber-based, leather-based, or wood.

As a general statement, the relatively low molecular weight polymer will range from about 50–100,000. In a more preferred embodiment, this range will be about 2,000–80,000. And in a still more preferred embodiment, this range will be about 20,000–60,000. These molecular weight ranges are provided for guidance purposes only, and the molecular weights actually employed can be either higher or lower depending upon the inclusion of tackifiers, which would in general extend the upper molecular weight acceptable in the product formulation.

The grip-enhancing formulation could include other typically additives which are known in the art, and might include for example, anti-oxidants, plasticizers. curing agents, tackifiers and other additives well-known in the polymer art.

The effectiveness of the grip-enhancing formulation is dependent upon its "tack", a widely used term, but difficult to quantify. Much of this is attributable to the fact that tack is a combination of many physical properties. In the adhesive industry, tack is demonstrated by what a system possessing it does, usually involving a simplistic measurement involving the thumb, forefinger, or both. Quantitatively, this leaves much to be desired.

For use in this application, tack may be thought of as the property of a material which enables it to form a bond of measurable strength immediately upon contact with another surface, usually with low applied pressure. Tack is thus, "instantaneous" adhesion and differs from ultimate strength. Within broad limits, tack would appear to be a rheological property. The strength developed is undoubtedly due to "van der Waals" forces and, to a lesser extent, diffusion and chain entanglement. Tack is sensitive to variations in temperature, pressure, rate of application and removal, and time of contact. Above a certain modicum of adhesiveness, tack varies as the rheological properties of the system. Thus, tack is a direct function of theological properties such as viscous flow, tensile strength or cohesion, modulus of elasticity, rate of elastic recovery, and deformability.

Tackifiers are additives which increase the tack of a substance. They are available in softening point ranges from room temperature to 150° C., and are usually quite soluble in aromatic solvents.

The best mode for carrying out the invention will now be described for the purposes of illustrating the best mode known to the applicant at the time. The examples are illustrative only and not meant to limit the invention, as measured by the scope and spirit of the claims.

EXAMPLES

The following grip-enhancing formulations were synthesized wherein all quantities are parts by weight.

TABLE I

| | Beeswax | Vistanex ® LMMH | Hercolyn ® D | Mineral Oil | Wingtack ® 98 | Paraffin Wax |
|---|---|---|---|---|---|---|
| 1 | 2 | .5 | | | | |
| 2 | 2 | 1 | | | | |
| 3 | 2 | 2 | | | | |
| 4 | 1 | 2 | | | | |
| 5 | .5 | 2 | | | | |
| 6 | 2 | | 1 | | | |
| 7 | 2 | | 5 | | | |
| 8 | 2 | 1 | .5 | | | |
| 9 | 2 | 1 | .5 | .5 | | |
| 10 | .5 | .5 | 1 | .8 | .3 | |
| 11 | 1 | .5 | | | | 1 |
| 12 | .5 | 2 | | | | .5 |
| 13 | .5 | 3 | | | | .5 |
| 14 | | 2 | | | | .5 |
| 15 | | 2 | | | | .3 |
| 16 | | 2 | 1 | | | 1 |

TABLE I-continued

| | Beeswax | Vistanex ® LMMH | Hercolyn ® D | Mineral Oil | Wingtack ® 98 | Paraffin Wax |
|---|---|---|---|---|---|---|
| 17 | | 2 | 2 | | | 2 |
| 18 | | 2 | .5 | | | .5 |
| 19 | 2 | 2 | | | | |
| 20 | 1.5 | 2 | | | | |
| 21 | 1 | 2 | | | | |

Suppliers for the above materials were: beeswax (Akrochem, yellow refined), Vistanex® LMMH (Exxon), paraffin wax (Arthur H. Thomas Co., refined paraffin 56°–58° C. melting point, mineral oil (Fisher Chemical, white heavy Saybolt viscosity 162 min., Hercolyn® C (Hercules Inc.), and Wingtack® 98 (Goodyear).

In preparing the above polymeric adhesive formulations which used beeswax (Akrochem yellow refined) and Vistanex® LMMH (Exxon), the components were mixed using the weight ratios indicated above in a beaker and heated to ~100° C. until the beeswax melted. The blend was removed from the oven and stirred while cooling, thereby building shear as it cools. This heating/cooling step was repeated if necessary to insure adequate mixing.

In formulating the product, a vinyl nitrile foamed polymer tube Halsted JC-HALDCH93121 was slit and cut to a length of about 7 inches. The inside of the slit foam was sprayed with spray adhesive (3M Super 77 spray adhesive) and felt, dimensioned to slightly larger than ~4 ½ inches by 5 inches was applied onto the inner side of the foam onto the spray adhesive area. The foam/adhesive/felt product was subsequently die-cut to ~4 ½ inches by 5 inches. The above polymeric adhesive formulation blend (5–7 grams) was applied onto the felt by heating the blend to ~100° C. using a hot roller applicator. To aid in the tubular configuration of the product, a post-heat treatment using a heat gun was applied to the product, with subsequent cooling in an essentially circular container. Similar procedures were employed using the other listed components in Table 1.

The tack of the prepared grip-enhancing products were tested for the following compositions using a 90° peel test, using a 1 inch sample and a crosshead speed of 0.5"/minute, the samples having been previously melted and applied between two pieces of a mylar substrate.

TABLE 2

| Vistanex ® (parts weight) | Beeswax (parts weight) | lbs./inch |
|---|---|---|
| 50 | 50 | 0.57 |
| 57 | 43 | 0.87 |
| 66 | 33 | 0.49 |
| 33 | 67 | 0.37 |
| 100 | 0 | 0.22 |

The range of tackiness for this combination would then be approximately between 0.2 to 1.0. Of course, this value may be higher or lower depending upon the particular grip-enhancing polymer blend used.

It is of course envisioned that the optimum grip enhancing formulation will potentially be different for various sporting or other activities. The preferred degree of tackiness will even vary from player to player and individual to individual, depending upon the needs of the application, the degree of sophistication of the participant, etc.

The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. An applicator for grip-enhancing substances which comprises:

(a) a foamed pliable polymer tubular member, the member having (i) an essentially non-absorbent outer portion, and (ii) an absorbent inner portion; and (b) a synthetic polymeric-containing grip-enhancing substance in associative contact with the inner portion, wherein the grip-enhancing substance is a polymer blend of a polymer and a wax which is a solid at room temperature, and further wherein the degree of tack which is transferrable onto an apparatus is controlled by the relative ratios between the polymer and the wax.

2. The applicator of claim 1 wherein the synthetic polymer-containing substance has a tack value of from 0.2 to 1.0.

3. The applicator of claim 2 wherein the polymer has a molecular weight from 50 to 100,000.

4. The applicator of claim 3 wherein the polymer has a molecular weight from 2,000 to 80,000.

5. The applicator of claim 4 wherein the polymer has a molecular weight from 20,000 to 60,000.

6. The applicator of claim 3 wherein the tubular member has a longitudinal slit disposed therein.

7. An applicator for grip-enhancing substances which comprises:

(a) an essentially foamed pliable polymer tubular outer member;

(b) an absorbent inner member in adhesive contact with the outer member and essentially contiguous therewith; and (c) a grip-enhancing substance in associative contact with the inner member, wherein the grip-enhancing substance is a polymer blend of a polymer and a wax which is a solid at room temperature, and further wherein the degree of tack which is transferrable onto an apparatus is controlled by the relative ratios between the polymer and the wax.

8. The applicator of claim 7 wherein the grip-enhancing substance is selected from the group consisting of pine tar and polymers having a tack value of from 0.2 to 1.0.

9. The applicator of claim 8 wherein the polymer has a molecular weight from 50 to 100,000.

10. The applicator of claim 9 wherein the polymer has a molecular weight from 2,000 to 80,000.

11. The applicator of claim 10 wherein the polymer has a molecular weight from 20,000 to 60,000.

12. The applicator of claim 7 wherein the inner member is a laminate having at least two layers.

13. The applicator of claim 12 wherein the laminate further comprises a barrier layer.

14. An applicator for grip-enhancing substances which comprises:

(a) an essentially foamed pliable polymer tubular outer member having a longitudinal slit disposed therein;

(b) an absorbent inner member in adhesive contact with the outer member and essentially contiguous therewith; and (c) a synthetic polymeric-containing grip-enhancing substance in associative contact with the inner member, wherein the grip-enhancing substance is a polymer blend of a polymer and a wax which is a solid at room temperature, and further wherein the degree of tack which is transferrable onto an apparatus is controlled by the relative ratios between the polymer and the wax.

15. The applicator of claim 14 wherein the synthetic polymer-containing substance has a tack value of from 0.2 to 1.0.

16. The applicator of claim 15 wherein the polymer has a molecular weight from 50 to 100,000.

17. The applicator of claim 16 wherein the polymer has a molecular weight from 2,000 to 80,000.

18. The applicator of claim 17 wherein the polymer has a molecular weight from 20.000 to 60,000.

19. The applicator of claim 14 wherein the absorbent inner member is a laminate having at least two layers.

20. The applicator of claim 19 wherein the laminate further comprises a barrier layer.

* * * * *

UNITED STATES PATENT AND TRADEMARK OFFICE

CERTIFICATE OF CORRECTION

PATENT NO. : 5,492,425
DATED : February 20, 1996
INVENTOR(S) : CARTER ET AL

It is certified that error appears in the above-indentified patent and that said Letters Patent is hereby corrected as shown below:

On the cover page item [75] Inventors:

delete the name of "Thomas W. McQuaide,

Union Town, Ohio".

Signed and Sealed this

Tenth Day of September, 1996

*Attest:*

Bruce Lehman

BRUCE LEHMAN

*Attesting Officer*

*Commissioner of Patents and Trademarks*